United States Patent [19]

Peterpaul

[11] 4,370,881

[45] Feb. 1, 1983

[54] DIE SET HAVING RESILIENT WORKPIECE RETENTION MEANS

[75] Inventor: Joseph Peterpaul, West Orange, N.J.

[73] Assignee: Thomas & Betts Corporation, Raritan, N.J.

[21] Appl. No.: 221,393

[22] Filed: Dec. 30, 1980

[51] Int. Cl.[3] ..... B21D 22/06

[52] U.S. Cl. ..... 72/402; 72/309; 72/396; 72/412; 72/465

[58] Field of Search ..... 72/412, 416, 410, 409, 72/416, 400, 401, 402, 422, 465, 304, 308, 307, 357, 396; 227/146; 140/93 D

[56] References Cited

U.S. PATENT DOCUMENTS

| | | | |
|---|---|---|---|
| 402,133 | 4/1889 | Betts | 72/389 |
| 461,041 | 10/1891 | Paddack | 72/465 |
| 2,433,040 | 12/1947 | Geist | 72/465 |
| 2,462,080 | 2/1949 | Erb | 72/396 |
| 3,181,341 | 5/1965 | Thornton et al. | 72/410 |
| 3,228,228 | 1/1966 | Myotte | 72/402 |
| 3,245,246 | 4/1966 | Filson | 72/401 |
| 3,263,475 | 8/1966 | Van de Kerkhof | 72/416 |
| 3,276,238 | 10/1966 | Erdmann | 72/410 |
| 3,616,674 | 11/1971 | Piasecki et al. | 72/412 |
| 3,756,064 | 9/1973 | Erdmann | 72/410 |
| 4,048,839 | 9/1977 | Peterpaul | 72/412 |

*Primary Examiner*—Lowell A. Larson

*Attorney, Agent, or Firm*—Robert M. Rodrick; Salvatore J. Abbruzzese; Jesse Woldman

[57] ABSTRACT

A die set for deforming a ferrule or similar article comprises a first die member and a cooperable second die member movable relative to the first die member along a central axis. The first die member includes first and second die elements that are disposed on opposite sides of the central axis and that are movable laterally toward and away from each other. The movable first and second elements define an expandable and contractable die nest for receiving a ferrule therein. A spring is provided for normally urging the die elements toward each other. The transverse spacing between the first and second die elements is chosen to provide an interference fit with the ferrule such that upon insertion into the die nest the ferrule is resiliently retained therein. The second die member has an anvil portion for entering into the die nest and deforming the ferrule resiliently held therein. Release of the ferrule after deformation is effected by sliding the ferrule out from the die nest.

15 Claims, 4 Drawing Figures

DIE SET HAVING RESILIENT WORKPIECE RETENTION MEANS

FIELD OF THE INVENTION

This invention relates to the field of die means and more particularly to a die set for deforming a ferrule or similar article about a conductor or the like.

BACKGROUND OF THE INVENTION

Various prior art devices are used to deform or crimp ferrules or other similar workpieces onto conductive wires or the like. A problem often encountered in the crimping art is the release of the workpiece from the crimping die after the workpiece has been deformed under compressive die forces. In general, this problem has been addressed and overcome by a number of devices such as that, for example, disclosed in U.S. Pat. No. 4,048,839 issued on Sept. 20, 1977 to Peterpaul and in U.S. Pat. No. 3,616,674 issued on Nov. 2, 1971 to Piasecki et al., both patents being assigned to the same assignee as is the present invention. In each of these devices the workpiece is supported by an anvil portion of the die set and then driven into an opposing die nest where it is deformed about conductive wires or the like. The die sets of each of these devices includes provision for assisting the release from the die nest upon disengagement of the die set members.

A difficulty with these devices, however, and other known devices wherein die members are normally spring biased apart to clear a workpiece, is the support of the workpiece in the die set prior to deformation. For example, in the devices of the two referenced patents an individual ferrule in a series of webbed ferrules is positioned on the anvil portion and held thereon by the rigidity of the webbed arrangement. No means is provided for effectively retaining a single piece entity in position on the anvil portion in a self-sustaining manner without external support means, manual or otherwise. While the use of the webbed ferrules is ideal for production purposes where crimping may be effected in rapid fashion, such die set structure is limited where individual, piecework applications, such as in maintenance or repair, are desired. While it is advantageous for a die set to have such ferrule retention capability, it is also desirable to crimp such ferrule without jamming in the die nest and to effect release of the crimped ferrule without excessive difficulty or labor.

SUMMARY OF THE INVENTION

It is an object of the present invention to provide an improved die set for deforming a workpiece.

It is another object of the present invention to provide a die set for deforming a ferrule or similar article and resiliently retaining such article prior to deformation.

In accordance with the invention, a die set for deforming a workpiece comprises a first die member including means defining an expandable and contractable die nest for resiliently holding a workpiece therein. Bias means is provided for normally maintaining the die nest in a contracted position. The die set includes a second die member having anvil means movable into the die nest to deform a workpiece therein.

In a preferred form of the invention, the die set is useful in deforming ferrules or similar articles. In such form, the first die member includes first and second elements movable toward and away from each other, each of the elements being disposed on opposite sides of a central axis and defining the die nest for resiliently receiving the article therein. The bias means normally urges the movable elements toward each other. The second die member is cooperable with the first die member and is movable relative thereto. The second die member has an anvil portion movable along the central axis between the first and second die elements to deform the article therein. In the preferred arrangement, the first and second elements are selectively spaced to provide an interference fit with an article to be deformed, such that upon receipt between the first and second elements, such ferrule is engaged thereby and resiliently retained therein.

DETAILED DESCRIPTION OF THE PREFERRED EMBODIMENTS

Figure 1:
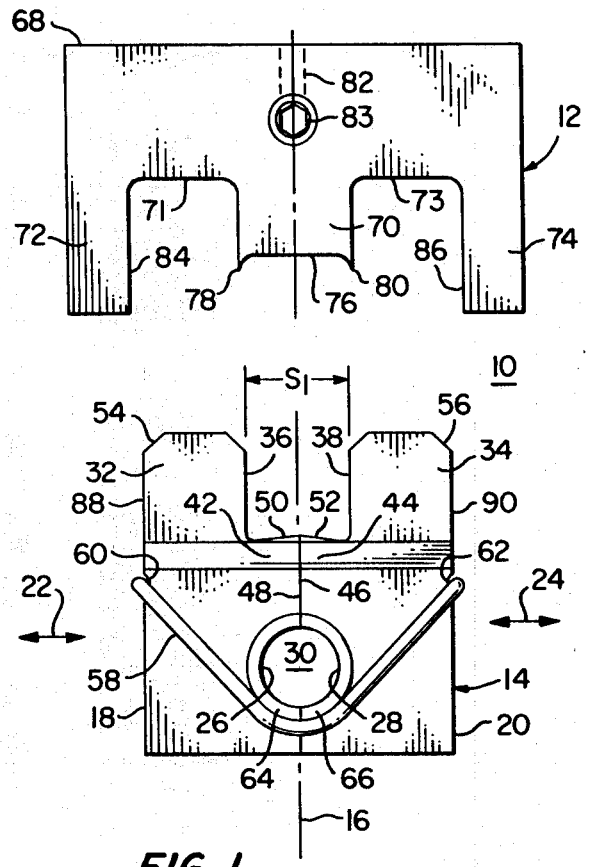
FIG. 1 is a front elevational view of the die set of the present invention with the lower die member in a contracted condition.

Referring to the drawing, there is shown in FIG. 1, a die set 10 in accordance with the invention comprising a pair of mateably cooperable die members 12 and 14 movable toward and away from each other along a central axis 16. It will be apparent to those skilled in the art that the die members 12 and 14 may be affixed to any suitable drive means (not shown) which may be, for example, either manually, pneumatically, hydraulically or electrically driven to provide the desired movement of the die members 12 and 14. It should also be understood that the die set 10 may be oriented in any suitable position relative to a vertical or horizontal axis, and that the relative positions of the die members 12 and 14 may be reversed from that shown in the drawing. For example, the die set 10 may be inverted such that the die member 12 is the lower member and the die member 14 is the upper member.

Figure 2:
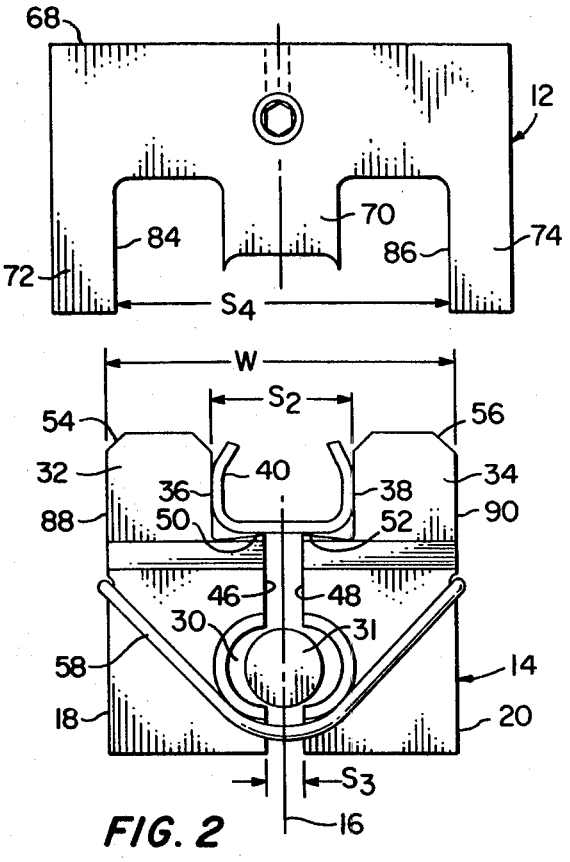
FIG. 2 is a front elevational view showing the device of FIG. 1 with the lower die member being in an expanded condition and resiliently holding a workpiece in the lower member.

The die member 14 in the configuration shown is split and comprises a left half portion 18 and a right half portion 20, each being independently movable toward and away from each other along a common plane in the directions of the arrows 22 and 24 substantially transverse the axis 16. Each die member portion 18 and 20 has a curved semicircular groove 26 and 28 that are aligned with each in facing relation and that combine to form a substantially circular aperture 30 for mounting the die member 14 onto a post 31 (FIG. 2) or other suitable structure in a crimping tool or the like. On each of the respective die portions 18 and 20 and movable therewith is a die element 32 and 34 projecting therefrom. Each of the die elements 32 and 34 has a substantially planar inner surface 36 and 38, respectively that, in combination, define a portion of a die nest for receiving and deforming a workpiece such as at 40 (FIG. 2).

Projecting transversely from each of the die elements 32 and 34 on the respective die portions 18 and 20 is a shoulder portion 42 and 44 that extend toward each other and terminate in respective planar surfaces 46 and 48.

On each of the shoulder portions 42 and 44 there are substantially planar surfaces 50 and 52, each surface 50, 52 lying adjacent the respective planar surfaces 36 and 38. The planar surfaces 50 and 52 serve as a base for supporting a workpiece 40 thereon and for restricting movement of such workpiece 40 in the direction of the axis 16 during the deforming operation and together with die element inner surfaces 36 and 38 form a generally U-shaped die nest. In the preferred form for purposes to be described, such surfaces 50 and 52 are inclined toward each other and in the direction of the die member 12, generally defining an upward and downward ramp configuration. Each of the die elements 32 and 34 is provided with an exterior tapered surface 54 and 56 adapted to suitably engage portions of the die member 12 as will be detailed.

A spring 58, preferably comprising a suitably tempered steel wire in a generally V-shape is supported on the respective die portions 18 and 20 in grooves 60 and 62. The spring 58 is arranged to extend across the widths of the die portions 18 and 20 around curved ring portions 64 and 66 projecting outwardly from the die portions 18 and 20 and lying adjacent the respective grooves 26 and 28. On the die portions 18 and 20, the spring 58 is formed to provide a force sufficient to bias such die portions 18 and 20 into engagement such that the planar surfaces 46 and 48 of the respective shoulder portions 42 and 44 are in abutting relation. It is preferred that the spring 58 be arranged to provide a relatively light force, on the order of about 6–10 ounces, such spring force being great enough to maintain the die portions 18 and 20 in engagement but readily overcome for lateral outward movement of the die portions 18 and 20. In the engaged condition, the die nest defined by the die elements 32 and 34 is considered to be in a fully contracted position. The die nest may be resiliently expanded against the bias of the spring 58 by movement of the die elements 32 and 34 or the die portions 18 and 20 away from each other.

In accordance with the invention, the inner surfaces 36 and 38 of the respective die elements 32 and 34 are selectively spaced apart at a spacing $S_1$ that is dimensioned less than the width extent of the workpiece 40 to be received, thereby providing an interference fit condition. For example, where a workpiece 40 such as a ferrule or connector has a width extent of 0.250 inch, the spacing $S_1$ may be dimensioned at 0.232 inch. As illustrated in FIG. 2, upon insertion of a workpiece 40 into the die nest, the die elements 32, 34 and hence die portions 18, 20 are moved laterally away from each other thereby increasing the spacing between die element inner surfaces 36, 38 to a spacing $S_2$ and providing a gap between the die portions 18, 20 as at $S_3$ whereby the shoulder surfaces 48 and 46 are in a separated relation. In this condition, the workpiece 40 is resiliently retained in the die nest by the die elements 32 and 34 under the influence of the bias spring 58. Also, as the die portions 18 and 20 are separated, the aperture 30 is elongated thereby providing additional clearance about the mounting post 31 for the die member 14. Such additional clearance allows the die member 14 to "float" laterally relative to the more rigidly fixed upper die member 12. Thus, as the die members 12 and 14 are brought together into engagement, the lower member 14 is capable of shifting and self-aligning with the upper member 12.

Referring to FIGS. 1 and 2, the die member 12 comprises a support portion 68, a central anvil portion 70 situated on the support portion 68 and a pair of leg portions 72 and 74 extending outwardly from the support portions 68 and spaced from and flanking the central anvil portion 70. There are substantially planar recessed surfaces 71 and 73 between the anvil portion 70 and the respective leg portions 72 and 74. The anvil portion 70 is arranged to move along the central axis 16 and enter the die nest in die member 14 and suitably deform a workpiece 40 held therein as will be described more fully. The anvil portion 70 has a substantially planar surface 76 in facing relation to the die member 14. At the marginal edges 78 and 80 of the anvil portion 70, it is preferred that the anvil portion be contoured to curve outwardly from the planar surface 76 and terminate in relatively sharp edges thereat. An aperture 82 may be provided in the support portion 68 for receipt of a post (not shown) or other suitable structure in a crimping tool or the like for mounting the die member 12 thereto. A set screw 83 may be provided to secure such mounting of the die member 12.

The leg portions 72 and 74 include relatively smooth inner surfaces 84 and 86, respectively that are arranged to initially engage the tapered die element surfaces 54 and 56 and then to bear against the exterior surfaces 88 and 90 of the respective die elements 32 and 34 to cause an inward lateral displacement of the die elements 32 and 34 toward the central axis 16 as the die members 12 and 14 are brought together. To effect such desired inward displacement, the fixed internal spacing $S_4$ between the leg portion interior surfaces 84 and 86, as shown in FIG. 2, is chosen to be less than the maximum width W of the die elements 32 and 34 as measured laterally thereacross when such die elements 32 and 34 are resiliently holding a workpiece 40 therebetween.

With reference first to FIG. 2, the sequence of the deformation of the workpiece 40 and the advantages of the present invention may be more fully appreciated. The workpiece 40, resiliently held in the die nest by the die elements 32 and 34, is shown as resting on the apexes of the inclined surfaces 50 and 52 in position to be deformed. One or more elongate members such as electrical conductors or the like may be inserted into the open end of the workpiece 40 to provide an electrical joint thereat upon being crimped. For the sake of simplicity, the conductors are not shown.

Figure 3:
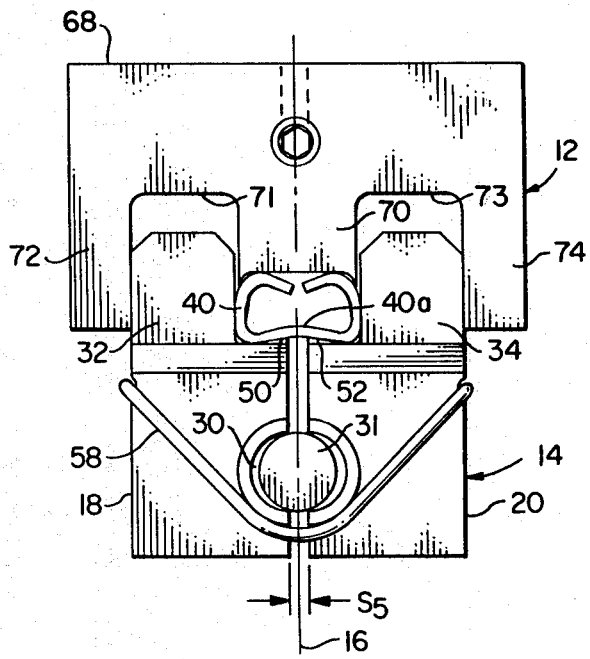
FIG. 3 is a front elevational view of the die set of the present invention showing the mating of the upper and lower die members and the deformation of the workpiece therein.

As the die members 12 and 14 are brought together along central axis 16 the leg portion inner surfaces 84 and 86 bear against die element exterior surfaces 88 and 90 while the anvil portion 70 initially engages the workpiece 40. Upon this movement, the die elements 32 and 34 and hence the die portions 18 and 20 are urged laterally inwardly, closing the gap between the die portions 18 and 20 from the spacing at $S_3$ to a lesser spacing as at $S_5$ as shown in FIG. 3 and providing a closed die nest for compressively deforming the workpiece 40. At the completion of the compression stroke as shown in FIG. 3, the workpiece 40 has been suitably deformed in accordance with the configuration provided by the die nest. The anvil portion 70 has driven the bottom wall of the workpiece onto the inclined surfaces 50 and 52, such workpiece bottom wall being deformed to follow the contour of such surfaces 50 and 52 whereby the central portion 40*a* of the workpiece bottom wall is buckled inwardly of the workpiece 40. Such buckling enhances the compression of the conductors therewithin during the compression operation. The depth of insertion of the anvil portion 70 between the die elements 32 and 34 may be controlled by a mechanical stop (not shown). The die elements 32 and 34 are dimensioned, however, to bottom against the recessed surfaces 71 and 73 during engagement of the die members 12 and 14 before the sharp edges 78 and 80 strike the surfaces 50 and 52 so as to prevent damage thereto. It should be understood that while the spring $S_5$ is less than the spacing $S_3$ during the crimping operation the gap between the die portions 18 and 20 does not close completely.

Figure 4:
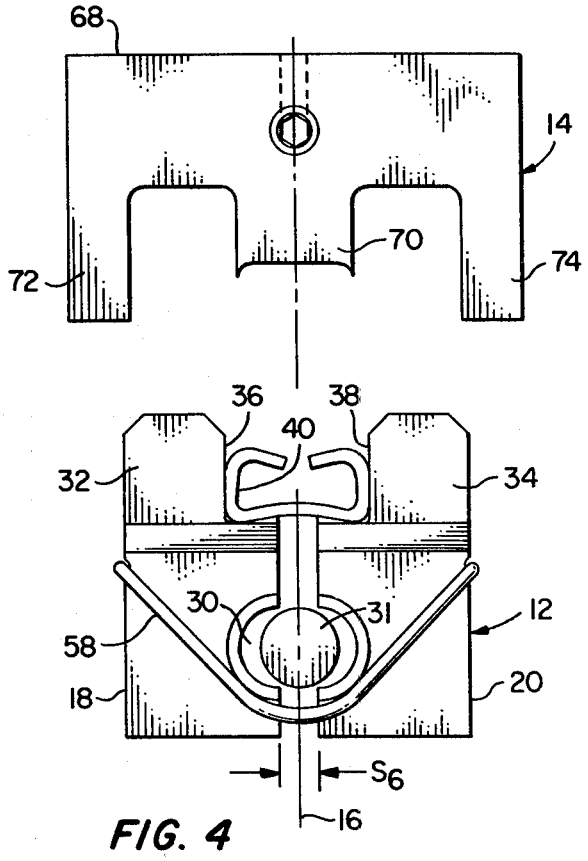
FIG. 4 is a front elevational view of the die set showing the disengagement of the upper and lower die members after deformation of the workpiece.

Upon disengagement of the die members 12 and 14 and withdrawal of the anvil portion from the die nest, the deformed workpiece is retained between the die elements 32 and 34. Due to the inherent resiliency possessed by most metals, a metallic article, such as workpiece 40, when subjected to a compressive force, tends to expand slightly after the compressive force is removed. In the case where one or more electrical conductors are contained within the workpiece 40, the recovery forces exerted by such compressed conductors tend to add to those of the workpiece 40 to increase the expansion. Thus, as the die members 12 and 14 are separated upon deformation of the workpiece 40 as illustrated in FIG. 4, the recovery forces of the compressed workpiece expand the die elements 32, 34 laterally outwardly against the light bias force of the spring 58 such that the gap between the die portions 18 and 20 increases from spacing $S_5$ to $S_6$. However, because of the capability of the die elements 32 and 34 to be expanded outwardly against the light spring bias, the deformed workpiece 40 is not jammed in the die nest but lightly, resiliently retained therein. Removal of the deformed workpiece 40 is readily effected by sliding the workpiece out from the die nest along the die element inner surfaces 36 and 38. Upon removal of the deformed workpiece 40, the die portions 18 and 20 are again urged into engagement by the spring 58 in position to receive another workpiece 40 for processing.

As described herein, the die member 14 is capable of holding in the die nest a workpiece 40 in an erect position with such workpiece being "face up" or "face down." In the preferred "face up" position as shown in the drawing figures, the workpiece 40 is capable of receiving electrical conductors therein that are free on one or both ends or secured at both ends. In the more limited "face down" position, electrical conductors having at least one free end are fed into the workpiece 40.

While the die set 10 of the present invention has been described herein in the preferred arrangement as a split die member 14 having two portions 18 and 20 movable relative to each other along a common plane, it should be appreciated that other expandable/contractable die set configurations may be used within the scope of the invention. For example, a single body may be employed with die elements slidably movable thereon with suitable bias means urging the die elements toward each other. More than two die elements may be used, one die element may be stationary or the die elements defining the die nest may be flexible. Other suitable bias means, such as, for example, rubber rings or the like may also be utilized.

Various other changes to the foregoing, specifically disclosed embodiments and practices will be evident to those skilled in the art. Accordingly, the foregoing preferred embodiments are intended in an illustrative and not in a limiting sense. The true spirit and scope of the invention are set forth in the following claims.

What is claimed is:

1. A die set for deforming a workpiece comprising:
a first die member;
an expandable and contractable die nest on said first die member;
means for biasing said die nest for securely retaining said workpiece therein; and
a second die member movable into engagement with said first die member to contract said die nest, said second die member including an anvil means movable into said contracted die nest for deforming said workpiece therein.

2. A die set according to claim 1, wherein said bias means is supported on said first die member.

3. A die set according to claim 1, wherein said die nest further comprises a plurality of elements movable toward and away from each other, said die nest being contractable and expandable upon respective movement of said elements toward and away from each other.

4. A die set according to claim 3, wherein said die nest comprises two such elements movable relative to each other along a common plane.

5. A die set according to claim 4, wherein said bias means comprises spring means.

6. A die set according to claim 5, wherein said spring means engages said die elements to normally urge said die elements toward each other.

7. A die set for deforming a ferrule or similar article comprising: a first die member including first and second elements movable toward and away from each other, each of said elements being disposed on opposite sides of a central axis and defining a die nest for resiliently receiving an article in an interference fit therein; bias means normally urging said first and second elements toward each other; and a second die member cooperable with said first die member and in movable relation thereto, said second die member having an anvil portion movable along said central axis between said first and second elements to deform said article therein.

8. A die set according to claim 7, wherein said bias means comprises a spring means.

9. A die set according to claim 7, wherein a shoulder portion is provided adjacent each of said die elements and extending from said die elements toward each other, said shoulder portion positioned to normally abut under the influence of said bias means, said shoulder portions defining a base for supporting a portion of said article.

10. A die set according to claim 9, wherein said elements are selectively spaced to receive therebetween an article in said interference fit such that upon receipt thereof said shoulders are in separated relation.

11. A die set according to claim 10, wherein said second die member includes means for engaging said die elements upon movement of said anvil portion between said first and second die elements and for moving said first and second die elements toward each other and thereby closing the separation between said shoulder portions.

12. A die set according to claim 11, wherein said engaging means includes a leg portion spaced from and flanking said anvil portion on either side thereof.

13. A die set according to claim 9, wherein said die nest defines a generally U-shaped interior channel wherein each of said die elements has a substantially planar surface in opposing facing relation for engagement with portions of said article and wherein each of said shoulder portions includes a substantially planar base surface.

14. A die set according to claim 13, wherein each of said shoulder portions includes an inclined surface extending outwardly from said respective die elements and inclining in a direction toward said anvil portion.

15. A die set for deforming a ferrule or similar article comprising: a split first die member including first and second portions movable toward and away from each other, said first and second portions respectively having first and second die elements in spaced facing relation to each other and disposed on opposite sides of a central axis, said elements defining a die nest for engagingly receiving an article therebetween, the spacing between said die elements being selectively dimensioned for an interference fit with such article, such that upon receipt of said article therebetween a gap exists between said first and second die portions; bias means for normally urging said die elements into engagement with said article for resiliently retaining said article therebetween; a second die member cooperable with said first die member and movable relative thereto, said second die member having a central anvil portion movable along said central axis and into said die nest and having means for engaging said first and second die elements and for moving said die elements toward each other and thereby drawing said die portions closer together as said anvil portion enters said die nest and deforms said article.

* * * * *